United States Patent [19]

Smirlock et al.

[11] Patent Number: 4,928,575

[45] Date of Patent: May 29, 1990

[54] SURVIVABILITY ENHANCEMENT

[75] Inventors: Martin E. Smirlock, Concord; William A. Ribich, Lexington; Paul J. Marinaccio, East Orleans, all of Mass.; Bernard E. Sawaf, Nashua, N.H.

[73] Assignee: Foster-Miller, Inc., Waltham, Mass.

[21] Appl. No.: 202,218

[22] Filed: Jun. 3, 1988

[51] Int. Cl.[5] ..... F41H 7/04

[52] U.S. Cl. ..... 89/36.02; 89/36.08; 52/489; 52/612

[58] Field of Search ..... 89/36.02, 36.06, 36.05, 89/36.08; 428/911; 109/49.5, 79, 80, 83; 52/612, DIG. 13, 489

[56] References Cited

U.S. PATENT DOCUMENTS

| | | | |
|---|---|---|---|
| 1,913,168 | 6/1933 | Longenecker | 52/489 |
| 2,789,076 | 4/1957 | Frieder et al. | 428/911 |
| 3,216,166 | 11/1965 | Brown | 52/489 |
| 3,500,773 | 3/1970 | Pfaff et al. | 89/36.02 |
| 3,624,749 | 11/1971 | Girard | 132/40 |
| 3,708,833 | 1/1973 | Ribich | 24/204 |
| 3,863,412 | 2/1975 | Bodycomb et al. | 52/DIG. 13 |
| 3,916,703 | 11/1975 | Ribich | 24/204 |
| 4,028,859 | 6/1977 | Bellagamba | 52/489 |
| 4,167,889 | 9/1979 | Bohne et al. | 89/36.02 |
| 4,169,303 | 10/1979 | Lemelson | 24/204 |
| 4,391,178 | 7/1983 | Pagano | 89/36.08 |
| 4,545,286 | 10/1985 | Fedij | 89/36.08 |
| 4,635,418 | 1/1987 | Hobgood | 52/DIG. 13 |
| 4,709,453 | 12/1987 | Harvey | 24/442 |
| 4,824,624 | 4/1989 | Palicka et al. | 428/911 |

FOREIGN PATENT DOCUMENTS

| | | | |
|---|---|---|---|
| 1168622 | 4/1964 | Fed. Rep. of Germany | 52/489 |
| 2621999 | 12/1977 | Fed. Rep. of Germany | 52/489 |
| 488420 | 12/1953 | Italy | 52/612 |
| 68019 | 2/1914 | Switzerland | 109/79 |
| 2007256 | 5/1979 | United Kingdom | 89/36.02 |

OTHER PUBLICATIONS

The Dow Chemical Company, Advanced Materials and Technology Brochure.

*Primary Examiner*—Charles T. Jordan
*Assistant Examiner*—Stephen Johnson
*Attorney, Agent, or Firm*—Fish & Richardson

[57] ABSTRACT

A survivability enhancement system includes first separable fastener structure fixed on the surface of the vehicle or system whose survivability is to be enhanced, and an array of armor tiles. The armor tiles provide a composite supplementary layer of armor that maintains attachment at effective levels even as armor tiles are subjected to large shear forces (for example, upon ballistic impact and shattering of an adjacent tile) and that has effective force dissipation characteristics. Each armor tile has opposed surfaces with second separable fastener structure complementary to the first separable fastener structure secured to one of its surfaces, one of the separable fastener structures having a multiplicity of projecting hooking elements and the cooperating fastener structure having complementary structure that is releasably interengageable with the hooking elements.

19 Claims, 3 Drawing Sheets

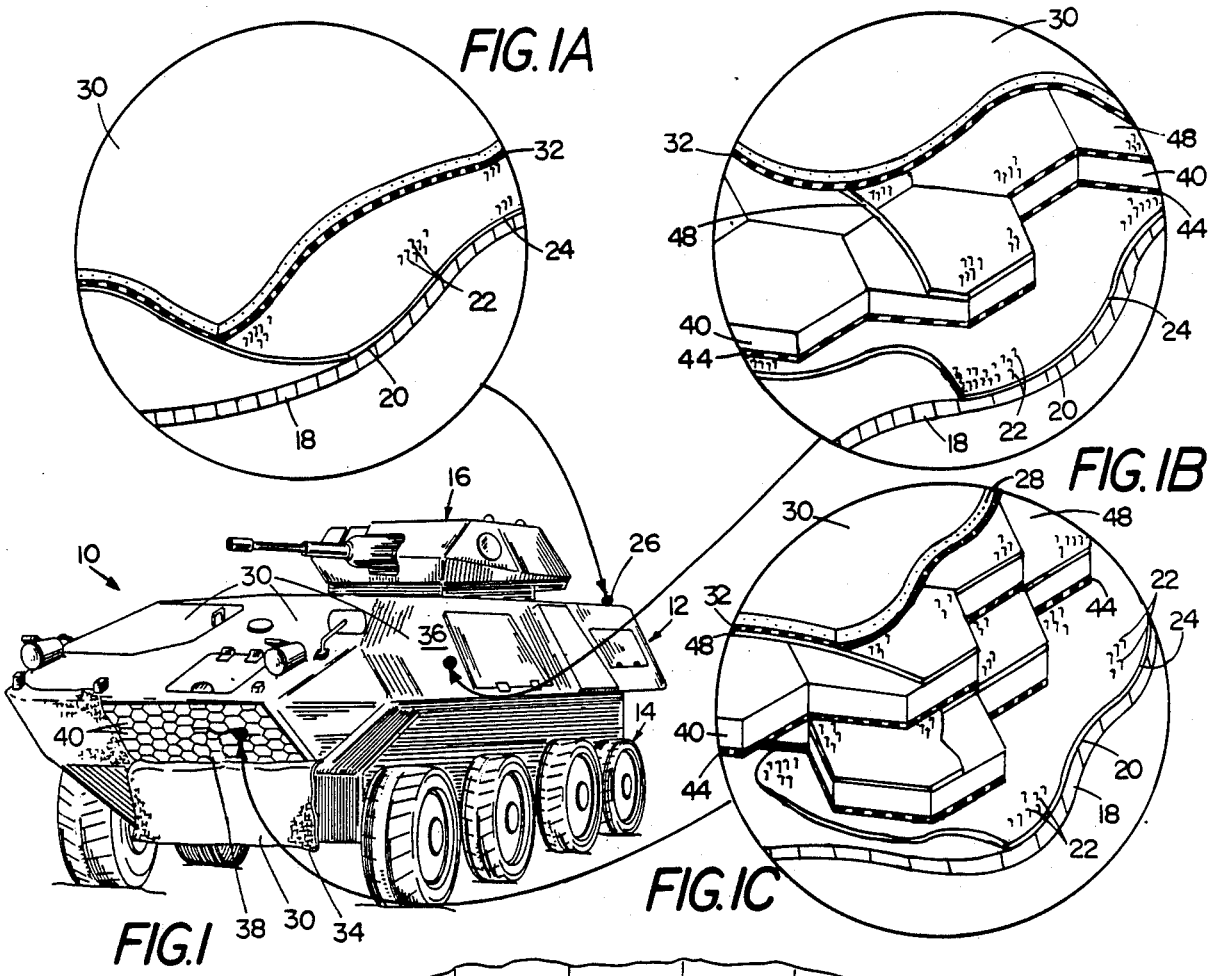
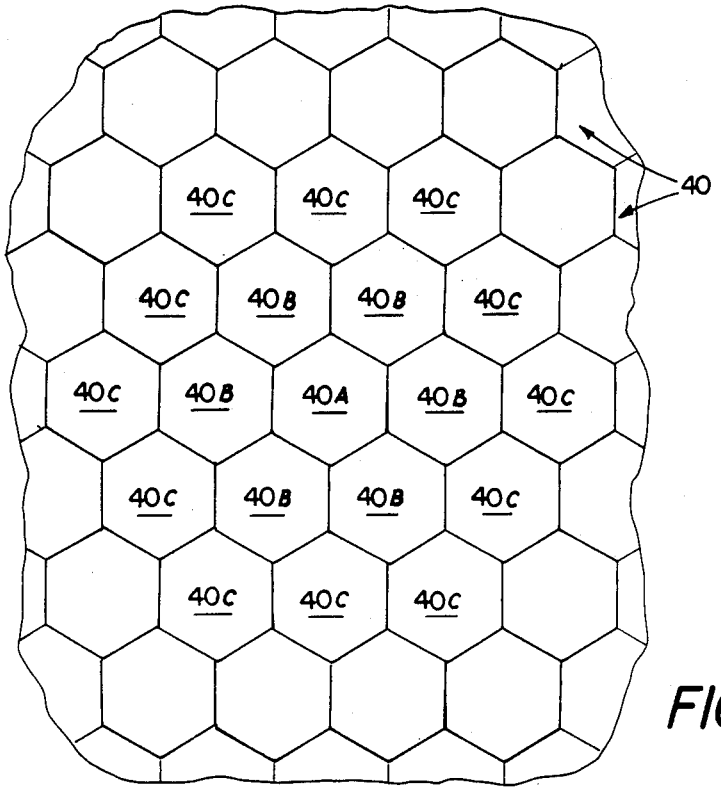
FIG. 2

SURVIVABILITY ENHANCEMENT

This invention relates to survivability enhancement, and more particularly to systems for enhancing the survivability of armored vehicles and the like.

Armored vehicles and systems are designed to provide ballistic protection commensurate with a specific threat. In connection with such vehicles and systems, the ability to readily vary the armor configuration or to quickly repair damaged armor as a function of particular threats to which the vehicle or system may be exposed may enhance survivability. Further, arrangements which reduce vehicle "signature" (as a function of electromagnetic radiation, infrared radiation, or the like) may also enhance survivability. The appearance of new vehicle armor in the field stimulates the development of new munitions with enhanced capability to defeat the newly fielded armor. Applique armor, that is, supplemental armor applied on top of the basic armor designed into the vehicle or system, has been proposed to enhance survivability. It has been proposed to attach such applique armor to the basic armor by adhesive bonding, by mechanical bolting and by magnetic attachment.

In accordance with one aspect of the invention, there is provided a survivability enhancement system, that includes first separable fastener structure fixed on the surface of the vehicle or system whose survivability is to be enhanced, and an array of armor tile elements, each armor tile element having opposed surfaces with second separable fastener structure complementary to the first separable fastener structure secured to one of its surfaces, one of the separable fastener structures having a multiplicity of projecting hooking elements (for example, of the hook or spear type) and the cooperating other fastener structure having complementary structure that is releasably interengageable with the hooking elements. Each armor tile element further has perimeter surface portions for mating juxtaposition with perimeter surface portions of adjacent armor tiles to provide a composite supplementary layer of armor with attachment structure that maintains attachment at effective levels even as armor tiles are subjected to large shear forces (for example, upon ballistic impact and shattering of an adjacent tile) and that has effective force dissipation characteristics. Preferably, the fastener structures in attached relation, have a tension restraint of at least about five psi and a shear restraint of at least about ten psi.

Preferably, the survivability enhancement system further includes flexible cover structure with separable fastener structure of the second type secured to the inner surface of the cover structure for fastening interengagement with separable fastener structure of the first type. The cover structure preferably includes signature reduction characteristics (in terms of electromagnetic radiation, infrared radiation or the like, as appropriate) and in a particular embodiment is of silicone rubber material with embedded particulate signal reduction material. While the armor tile may be of various materials, including metals and reactive (e.g., explosive) materials, in particular embodiments, the armor tile material is a ceramic material such as boron carbide, silicon carbide, aluminum oxide, titanium boride, or the like. Preferably, each ceramic armor tile has opposed planar surfaces and is at least about one centimeter thick and is of polygon configuration with perimeter edge surfaces at least about four centimeters long. Separable fastener structure of the first type is bonded to one planar surface of the armor tile and separable fastener structure of the second type is bonded to its opposed planar surface.

Preferably, one of the separable fastener structures includes a series of hook elements that extend upwardly from a base portion, each hook element including a flexible stem portion and a head portion, the head portion including a laterally-projecting inclined deflecting portion and a latch surface located between the deflecting surface portion and the stem portion for engaging a portion of the cooperating fastener structure in fastening relation. While the fastener elements may be of a variety of materials, including metals, in particular embodiments, the base portion and hook elements are of thermoplastic polymeric material such as nylon, polypropylene or the like, and the base portion of the fastener structure is adhesively bonded with epoxy or the like to the surface on which it is secured. In a particular embodiment, the cooperating fastener structure includes a multiplicity of loop elements.

Survivability enhancement systems in accordance with the invention enable easy installation of auxiliary armor elements, as well as easy removal and reapplication to facilitate future armor upgrades. No alterations or modifications of the basic armor of the vehicle or system are required, nor does the survivability enhancement system degrade the structural integrity of the basic armor. Easy replacement of damaged armor tiles in the field is possible. Interactions between adjacent armor tiles and between armor tiles and the base armor are such that destructive impact of a projectile on one tile results in minimal damage and or displacement of adjacent tiles. The structural integrity of the attachment system withstands normal system shocks, vibrations, brush loads, etc. Supplementary armor may be stored or transported separately from the vehicle for application in the field when enhanced armor is desired and may be selectively applied to selected portions of the vehicle, thus enhancing the versatility of the vehicle.

Other features and advantages of the invention will be seen as the following description of a particular embodiment progresses, in conjunction with the drawings, in which:

FIG. 1 is a view of a light armored vehicle that incorporates survivability enhancement in accordance with the invention, the enlarged views of FIGS. 1A, 1B and 1C illustrating particular configurations of survivability enhancement systems in accordance with the invention;

FIG. 2 is an elevational view of an array of armor tiles in accordance with the invention;

DESCRIPTION OF PARTICULAR EMBODIMENT

Figure 3:
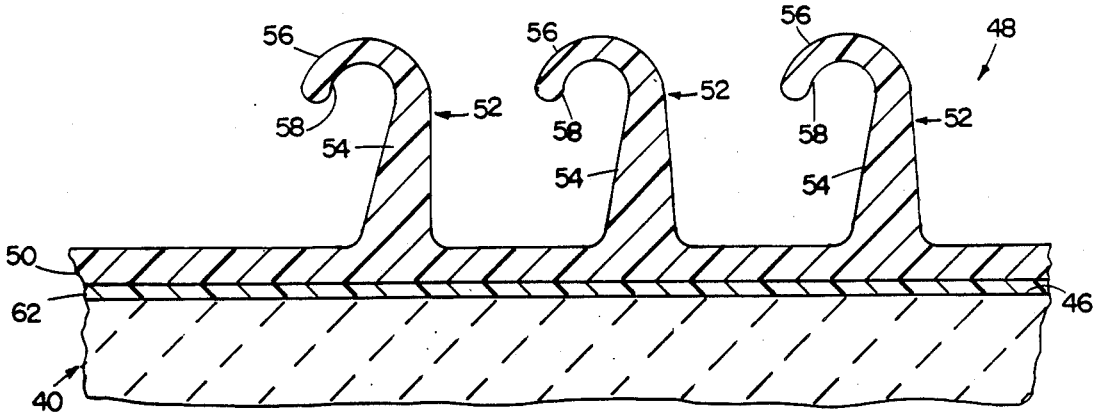
FIG. 3 is a sectional diagrammatic view of a portion of an armor tile in accordance with the invention.

Shown in FIG. 1 is a light weight high mobility vehicle 10 that includes hull 12 mounted on a series of driven wheels 14, and turret 16 on hull 12. Hull 12 is constructed of one quarter inch thick steel armor plate 18 and has fastener structure 20 on the outer surface of the steel hull. Structure 20 includes an array of upstanding hook elements 22 that are integral with base 24 and formed of injection-molded nylon, with base portion 24 secured to the surface of armor 18 with epoxy or other suitable adhesive. Hooks 22 have a height of about four millimeters, are flexible and facilitate resilient interengagement and disengagement with complementary structure of a cooperating separable fastener component.

Overlying fastener structure 20 is flexible cover sheet 30 which provides signature reduction (such as modified reflectivity to electromagnetic radiation, infrared radiation, or the like). Cover sheet 30 includes a silicone rubber substrate in which particulate signal reduction material 28 is embedded, sheet 30 having a thickness of about six millimeters. Secured on the inner surface of cover 30 by a suitable adhesive is fastener structure 32 which includes an array of loop elements 34 of polymeric material, the loops having heights of about three millimeters.

Figure 4:
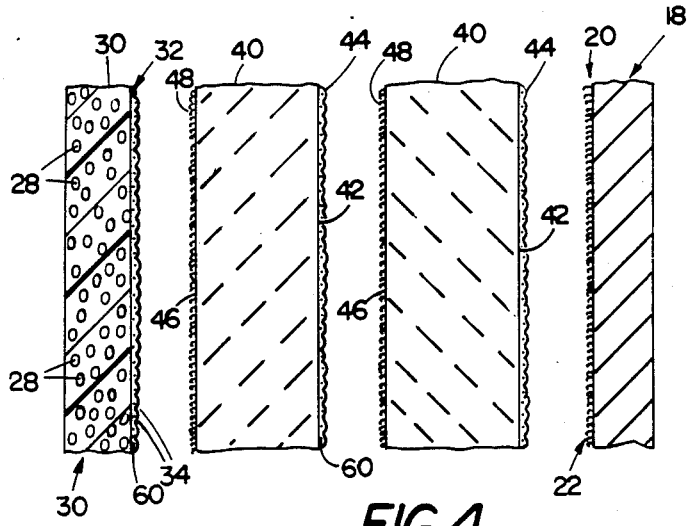
FIG. 4 is a sectional diagrammatic view of portions of components of the survivability enhancement system of FIG. 1 in spaced-apart relation.

Hook elements 22 of fastener structure 20 may be engaged with loop elements 34 of cover 30 in top region 26 as indicated in FIG. 1A. In other locations of the hull 12, one or more layers of ceramic armor tiles 40 may be interposed between hull 12 and cover 30, a single layer of armor tile 40 being provided in side region 36 as indicated in FIG. 1B and a double layer of armor tile 40 being provided in front region 38 as indicated in FIG. 1C. Each ceramic tile 40 is of boron carbide of about two centimeters thickness and has a hexagonal configuration with the straight edge sections of the perimeter having a length of about eight centimeters. As indicated in FIG. 4, secured on planar surface 42 of each tile 40 is separable fastener structure 44 similar to cover fastener structure 32, and secured on opposite surface 46 is separable fastener structure 48 of the hooking type similar to hull fastener structure 20. A portion of an array of armor tiles 40 secured on armor plate 18 is diagrammatically shown in FIG. 2.

As indicated in FIG. 3, fastener structure 48 includes base portion 50 and an array of hook elements 52, each of which includes flexible stem portion 54, deflection surface 56, and latch surface 58. It will be apparent that other hooking element configurations (of arrow or spear shape, for example) may be employed. Hooking elements 22 of the separable fastener structure 20 secured to hull 12 are of similar configuration. Cooperating separable fastener structures 32, 44 include nylon filament or metal wire loops 34 secured to base sheet 60. Separable fastener structures 44, 48 are secured to armor tile 40 with bonding agents 62.

Figure 5:
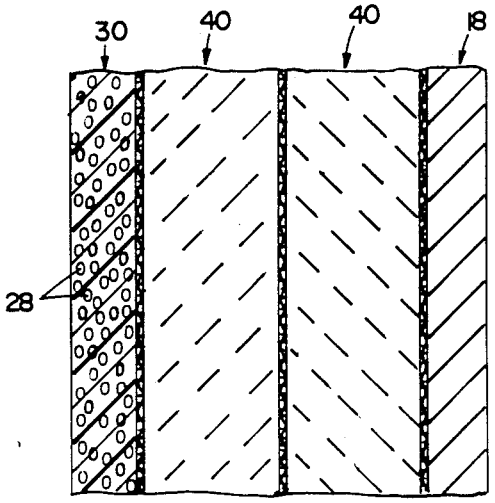
FIG. 5 is a similar diagrammatic view of the components of the survivability enhancement system of FIG. 4 in fastened relation.

Shown in FIGS. 4 and 5 are diagrammatic sectional views of components of the survivability enhancement system, the components being shown in spaced apart relation in FIG. 4 and in fastened relation in FIG. 5.

The holding force of the survivability enhancement fastener system is a function of the configuration, density and material of the hook elements 22, (52) as well as the size, number and material of loops 34. In a particular embodiment, the fastener structures 22, 34, in attached relation, have a tension restraint of about seven psi or a total of 180 pounds over the 26-square inch area of an individual tile 40; and a shear restraint of approximately fifteen psi or a total of 390 pounds for the 26-square inch area of a tile 40. The fastener arrangement provides compliance and compression force absorbance characteristics.

Figure 6:
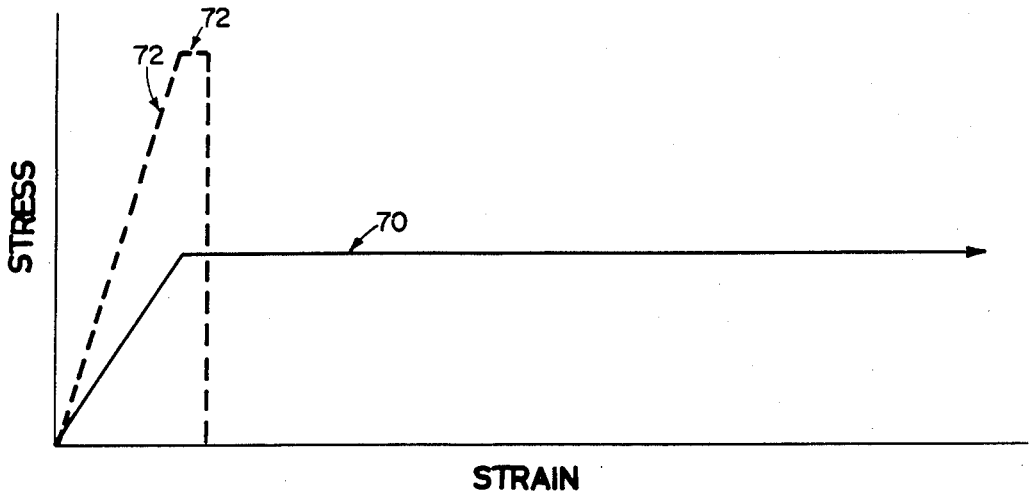
FIG. 6 is a graph illustrating stress/strain characteristics of a survivability enhancement system in accordance with the invention and of an adhesive bonding system.

Stress/strain relationship of hook-loop fastener arrangements subjected to lateral (shear) forces are indicated in the graph of FIG. 6. As indicated by line 70, with hooks 22 (52) engaged with loops 34, the stress/-strain relationship of the attachment force is maintained at a high level as a tile 40 is subjected to increasing shear force, loops 34 releasing but hooks 22 (52) picking up adjacent loops 34 and maintaining a high level attachment effect. Thus, the attachment system has energy absorbing characteristics, in contrast with an adhesive, for example, that, as indicated by line 72 in FIG. 6, provides resistance to shear forces up to peak 74 but fails when the adhesive bond is broken and then the tile 40 is no longer fastened to the armor substrate 18.

With reference to FIG. 2, a ballistic missle hit on tile 40A transfers energy to the six surrounding tiles 40B, and each of those immediately adjacent tiles 40B correspondingly transmits energy to the surrounding twelve tiles 40C. The armor system thus provides progressive energy dissipation and maintains substantial integrity of the armor.

Figure 7:
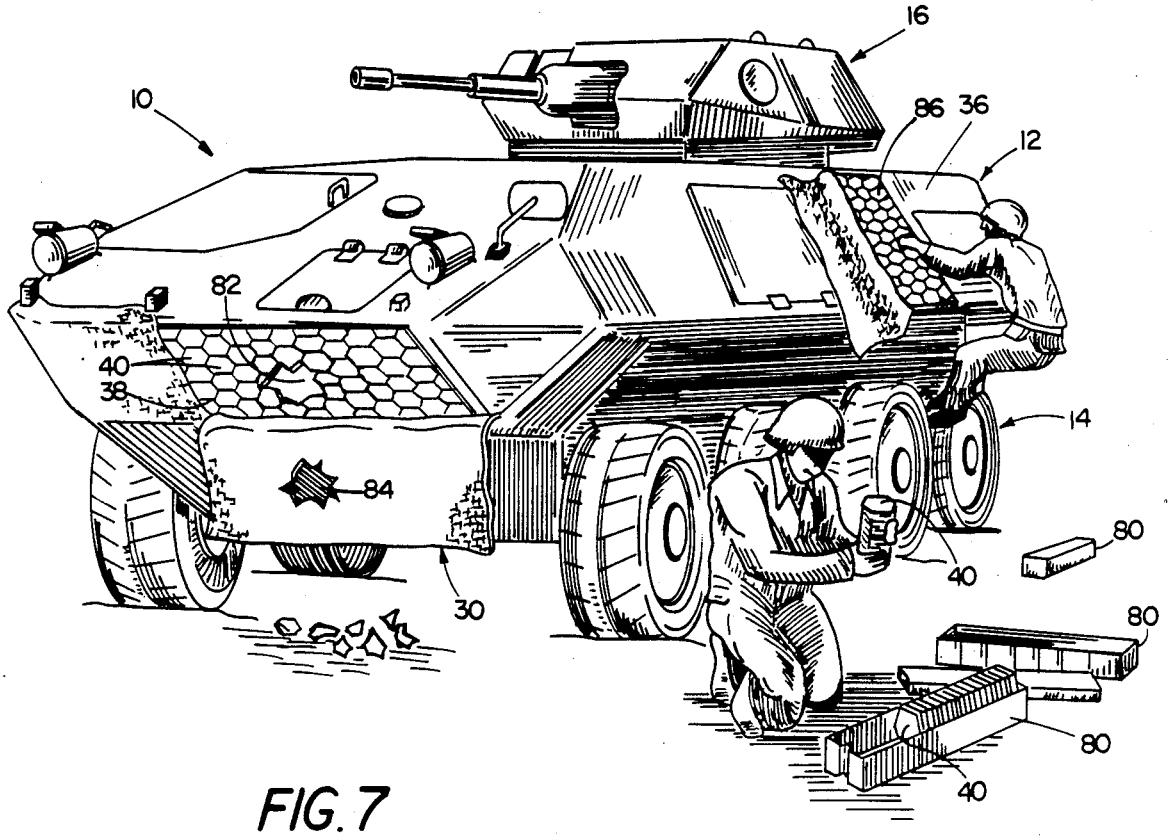
FIG. 7 is a view, similar to FIG. 1, of a light armored vehicle illustrating field replacement of armor tiles.

As indicated in FIG. 7, the armor tiles 40 may be supplied to the field in convenient transport containers 80. The tiles 40 in each container 80 have complementary fastener structures 44, 48 on their opposed surfaces and are readily installed on vehicle 10 in the field. For example, should tile armor 40 on front surface region 38 be damaged as indicated at 82, signature reduction cover 30 may be peeled down, and the damaged tiles removed (as with a pry tool) and replaced with substitute tiles 40 that are secured in place merely by pressing the tile 40 towards hull 12 to engage the complementary fastener structures. After tile replacement, cover 30 is resecured on the outer tile layer also by mere pressing. An auxiliary section of cover structure 30 may be secured over damage region 84 as desired. Similarly, other tiles 40 may be replaced or augmented in the field as indicated, for example, at 86 on side surface 36.

The survivability enhancement system incorporates armor tile with fastener structure that provides energy absorption and attachment that is maintained when exposed to large shear forces resulting, for example, from detonation of an explosive missle on an adjacent armor tile. Forces applied to adjacent tiles 40 may be adjusted as a function of the fastening system and are moderated by energy transfer to adjacent tiles and by the high sliding resistance of the fastener structures while not exceeding tensile or compression limits of the armor tiles 40.

While a particular embodiment of the invention has been shown and described, various modification thereof will be apparent to those skilled in the art, and therefor, it is not intended that the invention be limited to the disclosed embodiment or to details thereof, and departures may be made therefrom within the spirit and scope of the invention.

What is claimed is:

1. A survivability enhancement system for use on a vehicle that has a surface to which armor is to be releasably applied, comprising separable fastener structure of a first type fixed on said surface of said vehicle whose survivability is to be enhanced, and an array of armor tile elements for providing a composite supplementary layer of armor, each said armor tile element having a complementary surface that corresponds to said surface of said vehicle, and separable fastener structure of a second type and complementary to said first type separable fastener structure secured to said armor tile array, one of said separable fastener structures having a multiplicity of hooking elements and a cooperating other said fastener structure having complementary structure that is in releasable interengagement with said hooking elements, each said tile having perimeter surface portions in mating juxtaposition with perimeter surface portions of adjacent tiles to provide a composite supplementary armor layer on said vehicle, said survivability enhancement system having energy absorbing characteristics and providing progressive energy dissipation of energy resulting from impact of a ballistic missile on an armor tile element of said array such that an adjacent tile element that is not directly impacted by said ballistic missile but is subjected to lateral force, remains attached to said surface of said vehicle due to reengagement with said complementary structure by said hooking elements associated with said adjacent tile element that release from said complementary structure under influence of said lateral force.

2. The system of claim 1 and further including flexible cover structure with separable fastener structure of said second type secured to an inner surface of said cover structure for fastening interengagement with separable fastener structure of said first type.

3. The system of claim 2 wherein said cover structure includes vehicle signature reduction characteristics.

4. The system of claim 1 wherein the material of said armor tile elements is a ceramic material.

5. The system of claim 1 wherein each said armor tile element has a thickness of at least one centimeter and is of polygon configuration with edge surface segments of its perimeter that are at least four centimeters long.

6. The system of claim 1 wherein each said armor tile element has opposed planar surfaces, separable fastener structure of said first type is bonded to one planar surface and separable fastener structure of said second type is bonded to said one planar surface's opposed planar surface.

7. The system of claim 1 wherein said separable fastener structures in attached relation, have a tension restraint of at least five psi and a shear restraint of at least ten psi.

8. The system of claim 1 wherein each said hooking element includes a stem portion and a head portion that projects laterally from one side thereof, the head portion including an inclined deflecting portion and a latch surface located between said inclined deflecting surface portion and said stem portion for engaging a portion of a cooperating fastener structure in fastening relation.

9. The system of claim 8 wherein each said armor tile element has opposed planar surfaces, separable fastener structure of said first type is bonded to one planar surface and separable fastener structure of said second type is bonded to said one planar surface's opposed planar surface.

10. The system of claim 9 wherein said armor material is a ceramic material selected from the group consisting of boron carbide, silicon carbide, aluminum oxide, and titanium boride, each said armor tile element has a thickness of at least one centimeter and is of polygon configuration with edge surface segments of its perimeter that are at least four centimeters long.

11. The system of claim 9 and further including flexible cover structure with separable fastener structure of said second type secured to the inner surface of said cover structure for fastening interengagement with separable fastener structure of said first type.

12. A survivability enhancement system for use on a vehicle that has a surface to which armor is to be releasably applied, said survivability enhancement system having energy absorbing characteristics and providing progressive energy dissipation and comprising separable fastener structure of a first type fixed on said surface of said vehicle whose survivability is to be enhanced, an array of armor tile elements for providing a composite supplementary layer of armor, each said armor tile having a complementary surface that corresponds to said surface of said vehicle, separable fastener structure of a second type and complementary to said first type separable fastener structure secured to said complementary surface of each said armor tile, one of said separable fastener structures having a multiplicity of hooking elements and a cooperating other said fastener structure having complementary structure that is releasably interengageable with said hooking elements, flexible cover structure of rubber material with particulate vehicle signature reduction material embedded in said rubber material, and separable fastener structure of said second type secured to an inner surface of said cover structure for fastening interengagment with separable fastener structure of said first type.

13. A survivability enhancement system for use on a vehicle that has a surface to which armor is to be releasably applied, said survivability enhancement system having energy absorbing characteristics and providing progressive energy dissipation and comprising separable fastener structure of a first type fixed on said surface of said vehicle whose survivability is to be enhanced, an array of armor tile elements for providing a composite supplementary layer of armor, each said armor tile having a complementary surface that corresponds to said surface of said vehicle, and separable fastener structure of a second type and complementary to said first type separable fastener structure secured to said armor tile array, one of said separable fastener structures having a multiplicity of hooking elements, each said hooking element includes a stem portion and a head portion that projects laterally from one side thereof, the head portion including an inclined deflecting portion and a latch surface located between said inclined deflecting surface portion and said stem portion for engaging a portion of a cooperating fastener structure in fastening relation, a cooperating other said fastener structure having complementary structure that includes a multiplicity of loop portions that are releasably interengageable with said hooking elements, flexible cover structure of rubber material with particulate vehicle signature reduction material embedded in said rubber material, and separable fastener structure of said second type secured to an inner surface of said cover structure for fastening interengagment with separable fastener structure of said first type.

14. An applique armor system comprising a plurality of armor tiles, each said armor tile having opposed planar surfaces, a separable fastening component of a first type on one of said planar surfaces and a separable fastener component of a second type secured to the planar surface opposed to said one planar surface, one of said separable fastener components having a multiplicity of hooking elements, and the other separable fastener component having complementary structure for releasable interengagement with said hooking elements of said one separable fastening component, each said tile having perimeter surface portions for mating juxtaposition with perimeter surface portions of adjacent tiles to provide a composite supplementary armor layer, said armor system having energy absorbing characteristics and providing progressive energy dissipation of energy resulting from impact of a ballistic missile on an armor tile element of said array such that an adjacent tile element that is not directly impacted by said ballistic missile but is subjected to lateral force, remains attached to said surface of said vehicle due to reengagement with said complementary structure by said hooking elements associated with said adjacent tile element that release from said complementary structure under influence of said lateral force.

15. The system of claim 14 wherein each said hooking element includes a flexible stem portion and a head portion that projects laterally from one side thereof, the head portion including an inclined deflecting portion and a latch surface located between said inclined deflecting surface portion and said stem portion for engaging a portion of a cooperating separable fastener component of the second type in fastening relation.

16. The system of claim 14 wherein said separable fastener structures in attached relation, have a tension restraint of at least five psi and a shear restraint of at least ten psi.

17. An applique armor system that has energy absorbing characteristics and provides progressive energy dissipation comprising a plurality of armor tiles, each said armor tile having opposed planar surfaces, a separable fastening component of a first type on one of said planar surfaces and a separable fastener component of a second type secured to the planar surface opposed to said one planar surface, one of said separable fastener components being an integral member of molded thermoplastic polymeric material that includes a multiplicity of hooking elements and a base portion, said base portion being adhesively bonded to a planar surface of said armor tile, each said hooking element includes a flexible stem portion and a head portion that projects laterally from one side thereof, the head portion including an inclined deflecting portion and a latch surface located between said inclined deflecting surface portion and said stem portion, and the other separable fastener component having complementary structure for releasable interengagement with said hooking elements of a separable fastening component, each said tile having perimeter surface portions for mating juxtaposition with perimeter surface portions of adjacent tiles to provide a composite supplementary armor layer.

18. The system of claim 17 wherein said complementary releasably interengageable structure includes a multiplicity of loop portions.

19. The system of claim 18 wherein the material of said armor tiles is a ceramic material, each said armor tile has a thickness of at least one centimeter and is of configuration with edge surface segments of its perimeter that are at least four centimeters long.

* * * * *